US011849895B2

(12) United States Patent
LeCompte et al.

(10) Patent No.: US 11,849,895 B2
(45) Date of Patent: Dec. 26, 2023

(54) MOP WRINGERS AND BUCKET POSITIONING APPARATUS

(71) Applicant: MICRONOVA MANUFACTURING, INC., Torrance, CA (US)

(72) Inventors: Phillip LeCompte, Anaheim, CA (US); Kristin Stewart, Harbor City, CA (US)

(73) Assignee: MICRONOVA MANUFACTURING, INC., Torrance, CA (US)

( * ) Notice: Subject to any disclaimer, the term of this patent is extended or adjusted under 35 U.S.C. 154(b) by 107 days.

(21) Appl. No.: 16/643,576

(22) PCT Filed: Sep. 5, 2018

(86) PCT No.: PCT/US2018/049563

§ 371 (c)(1),
(2) Date: Mar. 1, 2020

(87) PCT Pub. No.: WO2019/050961

PCT Pub. Date: Mar. 14, 2019

(65) Prior Publication Data

US 2020/0196826 A1 Jun. 25, 2020

Related U.S. Application Data

(60) Provisional application No. 62/554,510, filed on Sep. 5, 2017.

(51) Int. Cl.
*A47L 13/59* (2006.01)

(52) U.S. Cl.
CPC ..... *A47L 13/59* (2013.01)

(58) Field of Classification Search
CPC . A47L 13/58; A47L 13/59; A47J 47/18; A47J 47/16; E06C 7/14; B65D 7/02
(Continued)

(56) References Cited

U.S. PATENT DOCUMENTS 2,001,894 A * 5/1935 Smith ..... A47J 47/16 15/264
2,049,619 A 8/1936 Pavek
(Continued)

FOREIGN PATENT DOCUMENTS

EP 1344485 9/2003
EP 2255714 B1 10/2013
(Continued)

OTHER PUBLICATIONS

Translation of FR925435A, retrieved from Espaceent on Mar. 8, 2022 (Year: 1946).*
(Continued)

*Primary Examiner* — Tom Rodgers
(74) *Attorney, Agent, or Firm* — Henricks Slavin LLP

(57) ABSTRACT

A wringing assembly may include a plurality of spaced apart pressure applicators, such as may be used for applying pressure to a mop element having a cleaning, absorbent or wiping material supported on the mop element. The pressure applicators may be supported so as to be centered or symmetrical on each side of a center of a wringing surface. The wringing assembly may include a substantially centered actuation element such as a handle. An actuation element on a wringing assembly may also include a receptacle for an element of a mop or other cleaning tool, such as a handle A bucket positioning device includes a spring-loaded assembly having a hook for a bucket rim and a base for engaging a bottom of a bucket or a wheel unit.

12 Claims, 13 Drawing Sheets

(58) Field of Classification Search
USPC ..... 15/260, 261, 264; 248/16, 126, 149; 220/23.4
See application file for complete search history.

(56) References Cited

U.S. PATENT DOCUMENTS

| | | | | |
|---|---|---|---|---|
| 2,519,149 | A * | 8/1950 | Mcwethy | A47J 47/18 294/159 |
| 7,377,004 | B2 | 5/2008 | LeCompte et al. | |
| 2013/0139848 | A1 | 6/2013 | Goentzel | |
| 2016/0031073 | A1 | 2/2016 | Stewart et al. | |
| 2016/0066764 | A1 | 3/2016 | Yang et al. | |

FOREIGN PATENT DOCUMENTS

| | | | | |
|---|---|---|---|---|
| ES | 2139511 | A1 | 2/2000 | |
| FR | 925435 | A * | 9/1947 | F42B 39/26 |
| GB | 2412568 | | 10/2005 | |
| WO | WO 2008/007395 | | 1/2008 | |
| WO | WO 2017/063675 | | 4/2017 | |

OTHER PUBLICATIONS

Trimarchi, Roberto, Supplementary European Search Report, dated Sep. 2, 2021, 3 pages, European Patent Office, Munich, Germany.
Soo, Eng Wei, International Search Report, dated Dec. 10, 2018, 5 pages, Australian Patent Office, Woden ACT, Australia.
Soo, Eng Wei, Written Opinion of the International Searching Authority, dated Dec. 10, 2018, 5 pages, Australian Patent Office, Woden ACT, Australia.

* cited by examiner

MOP WRINGERS AND BUCKET POSITIONING APPARATUS

CROSS REFERENCE TO RELATED APPLICATIONS

This application is a National Stage of International Application No. PCT/US18/49563, filed Sep. 5, 2018, which claims priority from 62/554,510 filed Sep. 5, 2017, the entire contents of which are incorporated herein by reference.

BACKGROUND

Field

These inventions relate to mop wringers, wringing mechanisms for flat mops, and to bucket clamps for helping to position buckets next to each other.

SUMMARY

Examples of wringing assemblies are described, including wringing assemblies for mops, including flat mops, and mop elements that can be placed on an extended surface for wringing the mop. In some examples, the surface is a planar surface extending laterally of the wringer and having a width transverse of the lateral direction for supporting a material to be wrung. In other examples, the surface is concave in transverse cross-section as would be seen by the mop element, and also or alternatively concave as seen by the mop element in the lateral direction.

In one example of a wringing assembly, the assembly includes a wringing surface extending laterally and a wringing actuator positioned intermediate lateral end portions of the wringing surface. In one example, the wringing actuator is approximately centered between the lateral end portions of the wringing surface. In one configuration, the wringing actuator includes a handle for manually actuating the wringing assembly, in another configuration the wringing actuator includes a receptacle for a mop handle for actuating the wringing assembly, and in a further configuration the wringing actuator includes both. In one configuration, the wringing actuator extends upward away from the wringing surface when the wringing actuator is in a non-wringing configuration, or when the wringing actuator is in a resting or relaxed configuration. In one example where the wringing actuator extends upward, the wringing actuator can include a handle or other manually accessible surface at an end portion of the wringing actuator, and in another example, the wringing actuator extends upward and includes a mop handle receptacle for receiving a portion of a mop handle, for example for allowing a user to actuate the wringing assembly using the mop handle. In examples where the wringing actuator includes a mop handle receptacle, it is advantageous, though not necessary, to have the wringing actuator approximately centered laterally in the wringing assembly.

In another example of a wringing assembly, the assembly includes a laterally extending wringing surface and a width transverse to the lateral extent of the wringing surface. In one example, the wringing surface is substantially planar, and in another example the wringing surface is concave as viewed from a mop element placed on the wringing surface. In one example, the wringing surface is concave in a transverse cross-section (sagittal), in another example the wringing surface is concave laterally as viewed from the front, and in a further example concave in both directions transverse and laterally.

In a further example of a wringing assembly, a wringing assembly includes a wringing surface extending laterally and transversely of the lateral direction, and further includes a plurality of pressure applicators for applying pressure to a mop material for extracting fluid from the mop material. In one example, the plurality of pressure applicators is a pair of pressure applicators configured to apply pressure in the direction of the wringing surface. In one configuration, the pair of pressure applicators are configured to apply pressure in the direction of or toward the wringing surface at lateral positions on opposite sides of a center of the wringing surface. In another configuration, the pair of pressure applicators are configured to apply pressure in the direction of the wringing surface along a lateral centerline of the wringing surface. In one example, at least one of the pressure applicators includes a pressure surface that extends laterally, and in another example, the at least one pressure applicator includes a pressure surface that extends laterally along a substantially straight line. In a further example, the at least one pressure applicator includes a pressure surface that is curved in a transverse direction, and in a further example, the at least one pressure applicator includes a substantially rounded pressure surface as viewed in transverse cross-section. In a still further example, at least a pair of the plurality of pressure applicators are identical to each other.

In an example of a wringing assembly, such as any of those described herein, that includes a plurality of pressure applicators for applying pressure to a mop material for extracting fluid from the mop material, the plurality of pressure applicators apply pressure to an adjacent surface for wringing fluid from a material, and the plurality of pressure applicators have surfaces for applying pressure, wherein the surfaces make contact over less than 100% of a mop head surface available for contact by a pressure surface for wringing the mop head. In one example, the surfaces make contact over less than 50% of a mop head surface available for contact by a pressure surface, and in another example less than 10% of a mop head surface available for contact by a pressure surface. In an example of a flat mop wherein the flat mop has a relatively planar support surface for a cleaning material or an absorbent material, the planar support surface may have an available surface area for receiving pressure applied by a mop wringer, and a mop wringer such as any of those described herein can apply pressure to the planar support surface over less than 100% of the available surface area for receiving pressure. In one example, it is less than 50%, and in another example of the less than 10%, which may be suitable where the mop head has a planar support element that is relatively rigid and can transmit the pressure from the pressure applicators to the mop material for wringing the mop material.

In an example of a wringing assembly having a pressure applicator for applying pressure to a mop material for extracting fluid from the mop material, the pressure applicator may include a resilient bias for biasing the pressure applicator in a direction toward the mop material. In one example of the apparatus described herein, a pressure applicator may include a plurality of bias elements for biasing the pressure applicator in a direction of the mop material. For example, a pressure applicator may include a plurality of compression springs for biasing the pressure applicator toward the mop material.

A bucket positioning device may be configured to assist in positioning buckets adjacent each other. In one example, a bucket positioning device may include a bias element for applying tension between upper and lower portions of a bucket. In another example, a bucket positioning device may include a plurality of hooks for engaging respective rims of buckets to be positioned adjacent each other. In a further example, a bucket positioning device may include a plurality of bucket body engagement surfaces for engaging respective engagement surfaces on adjacent buckets. In one configuration, a bucket positioning device may include a bias element and a plurality of hooks and bucket engagement surfaces for helping to position adjacent buckets relative to each other. These and other examples are set forth more fully below in conjunction with drawings, a brief description of which follows.

DETAILED DESCRIPTION

Figure 1:
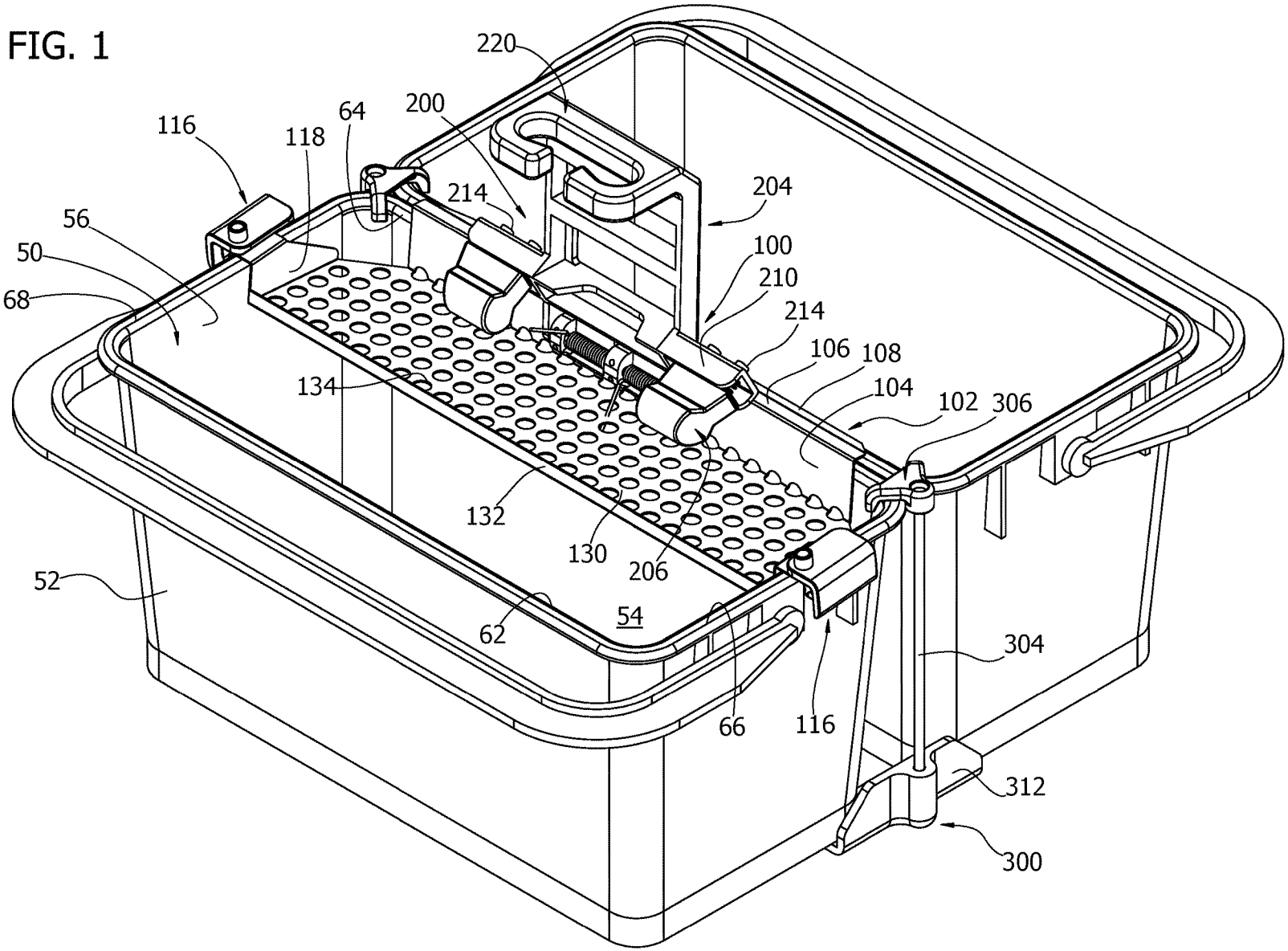
FIG. 1 is an upper left isometric view of a wringer assembly supported on a bucket of a two-bucket system used for wringing a mop.

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of wringers and of methods of making and using the wringers are described. Depending on what feature or features are incorporated in a given structure or a given method, benefits can be achieved in the structure or the method. For example, wringers having centered as opposed to laterally offset actuating handles or levers can be more stable and easier to use. Additionally, wringers having pressure applicators with a small footprint may also be easier to use, for example when a mophead is being positioned for wringing.

In some configurations of wringers, improvements can be achieved also in using the wringer in combination with a mop, such as where a mop handle can help in actuating the wringing process. Additionally, wringing with a mop where the mophead has a defined support element for an absorbent material or mopping material may help in more predictably removing moisture from the mopping material.

These and other benefits will become more apparent with consideration of the description of the examples herein. However, it should be understood that not all of the benefits or features discussed with respect to a particular example must be incorporated into a wringer, component or method in order to achieve one or more benefits contemplated by these examples. Additionally, it should be understood that features of the examples can be incorporated into a wringer, component or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method.

Examples of a number of wringer configurations and of methods of making and using the wringers are described herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

As used herein, "substantially" and "approximately" shall mean the designated parameter or configuration, plus or minus 10%. However, it should be understood that terminology used for orientation or relative position, such as front, rear, side, left and right, upper and lower, and the like, may be used in the Detailed Description for ease of understanding and reference, and may not be used as exclusive terms for the structures being described and illustrated.

Figure 2:
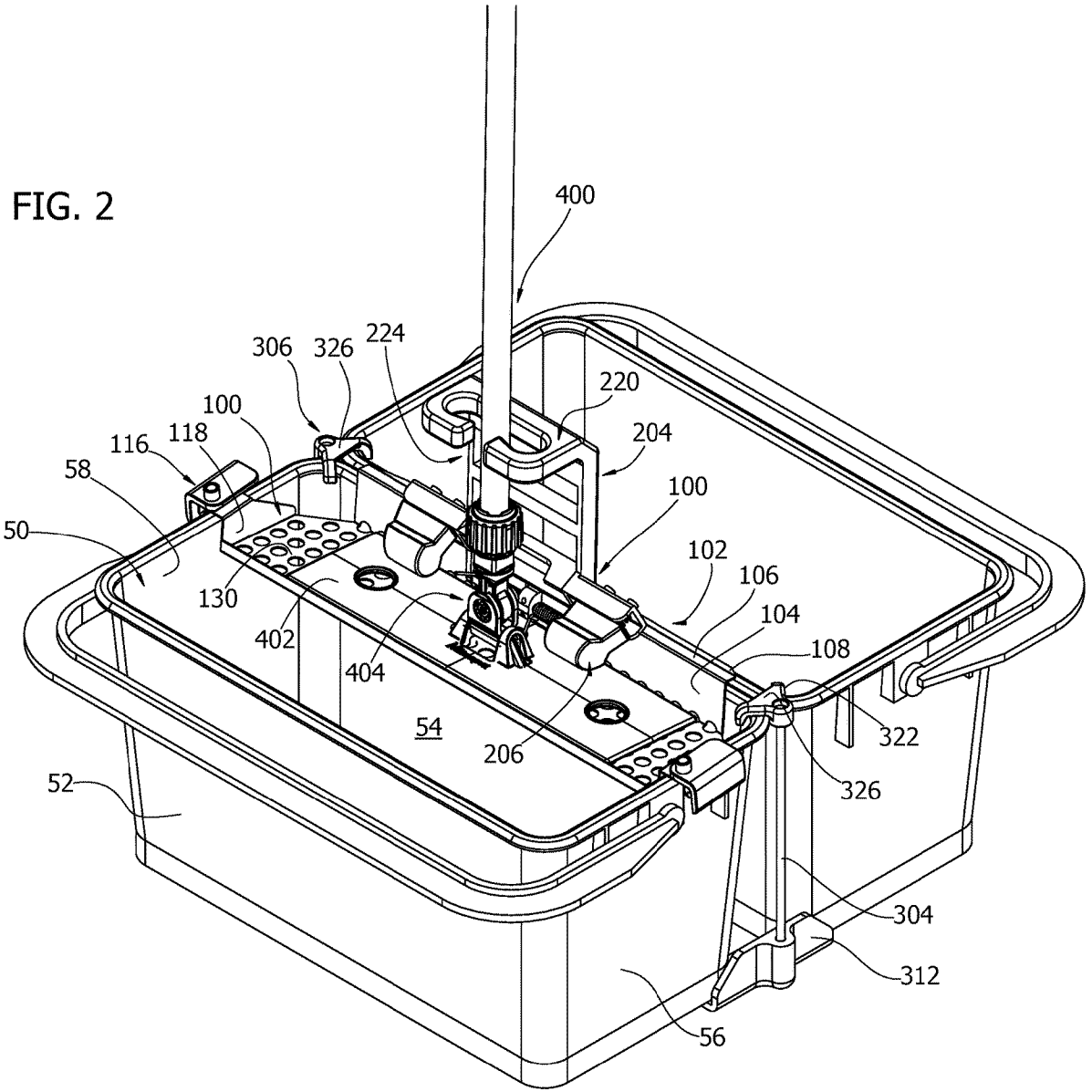
FIG. 2 is a wringer assembly supporting a mop to be wrung by the wringer assembly and an actuator lever in an initial position.
Figure 3:
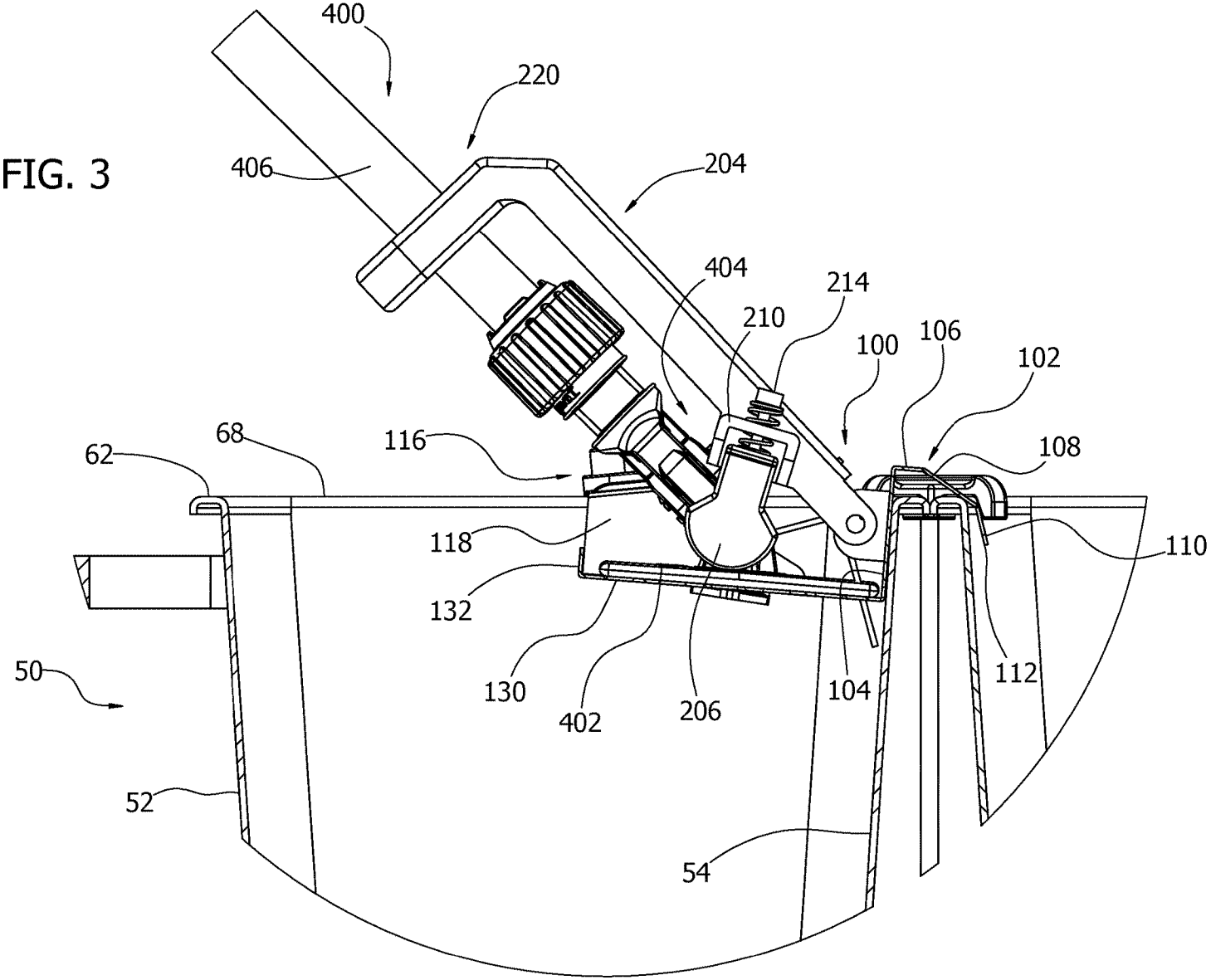
FIG. 3 is a partial cross section and detail view of the assembly of FIG. 2 showing the wringer assembly in a wringing configuration.
Figure 5:
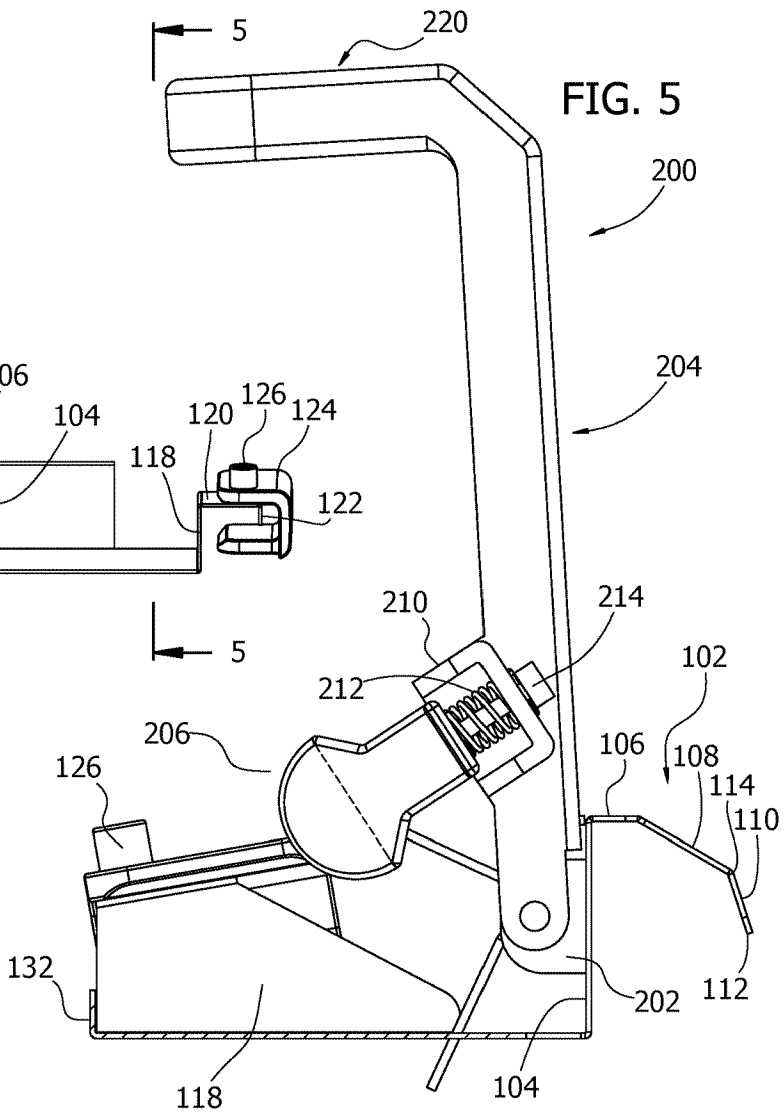
FIG. 5 is a sagittal section and side view of the wringing assembly taken along line 5-5 of FIG. 4.

In an example of a wringer assembly (FIGS. 1-7), for example one that can be used for wringing mop elements or other cleaning and/or absorbent tool elements, a wringer assembly 100 can be used in a number of applications. In the illustrated configurations, the wringer assembly 100 is supported on a bucket 50 (FIGS. 1-3). The wringer assembly can also be supported on other structures such as other containers, receptacles or other structures, which may be portable, movable or fixed, according to the desired application. Often the wringer assembly is supported on a bucket or other container or receptacle for receiving and containing fluid wrung from a material, for example a cleaning or absorbent material on a tool such as a mop, described more fully below.

The wringer can be supported on the bucket in any number of ways, and the support configuration may be a function of the bucket configuration. The configuration of the wringer and its support components may be determined by the bucket configuration on which the wringer would be supported. In the present example, the bucket 50 is a fluid containing, slightly diverging straight-walled bucket having a rectilinear configuration having a long front wall 52 and rear wall 54, and a shorter right wall 56 and left wall 58 (FIGS. 1-2) extending from a bottom (not shown) to respective rims 62, 64, 66 and 68. In the present example, the wringer assembly 100 is supported on rims of the bucket, though it is understood that the wringer assembly can be supported on other structures of a bucket or other container than rims of the container. In the illustrated example, the wringer assembly 100 is supported at three spaced apart locations on the bucket, though it can be supported with other configurations according to the application and the combination of wringer and support.

The wringer assembly 100 includes a first support structure 102 (FIGS. 1-5) extending longitudinally of the wringer assembly. In the present example, the first support structure 102 is an inverted channel similar to the support element 50 described and illustrated in U.S. Pat. No. 7,377,004, the contents of which are incorporated herein by reference. The support structure 102 extends longitudinally almost the entire length of the wringer, but for end portions allowing for accommodating boundaries or end surfaces of the bucket on which the wringer assembly would be supported. For example, with an approximately 19 inch long wringing surface, as described more fully below, the support structure 102 may join the wringing surface over approximately 16 inches, or over a range of approximately 70% to 90%, depending on the wringer and bucket configurations. When supported on a bucket as illustrated in the accompanying Figures, the wall 104 is angled slightly in conformance with the angle of the rear wall 54. The support structure is formed from a substantially vertical wall 104 (FIGS. 1-3), and whether or not the wall 104 is vertical or otherwise in application will depend on the configuration of the bucket on which it is supported. The support structure also includes an upper wall 106 extending substantially perpendicular away from the vertical wall 104 and away from the wringing assembly to an angled wall 108 extending downwardly and away from the wringing assembly at an angle of approximately 70° from the upper wall or from a vertical line when the wall 104 is vertical. The angled wall 108 terminates at an outer downwardly-extending wall 110 extending downwardly to a lower free edge 112. The wall 110 diverges by a few degrees from the wall 104, in the present example approximately 30° from the angled wall 108. A junction 114 between the angled surface 108 and the downwardly-extending surface 110 occurs along a line at a vertical distance less than half the vertical height of the wall 104. The angles identified for the walls of the support structure are angles for the support structure when in a relaxed configuration, for example before the wringing assembly is applied to the rim of a bucket. Other angles can be used to provide the desired support for the wringing assembly on a bucket or other support structure.

In the present example, the wringer assembly 100 is supported at two other points of the assembly at opposite sides of the bucket, and on each side of the support structure 102. The wringer assembly 100 includes a pair of support bracket assemblies or clamp assemblies 116, each of which in the present example are mirror images of the other, and only one clamp assembly 116 will be described in this example. Each clamp assembly 116 is positioned at a longitudinal end of the wringer assembly 100, and closer to a front of the wringer assembly than to the support structure 102. Other positioning for clamp assemblies can be used additionally or alternatively.

Figure 4:
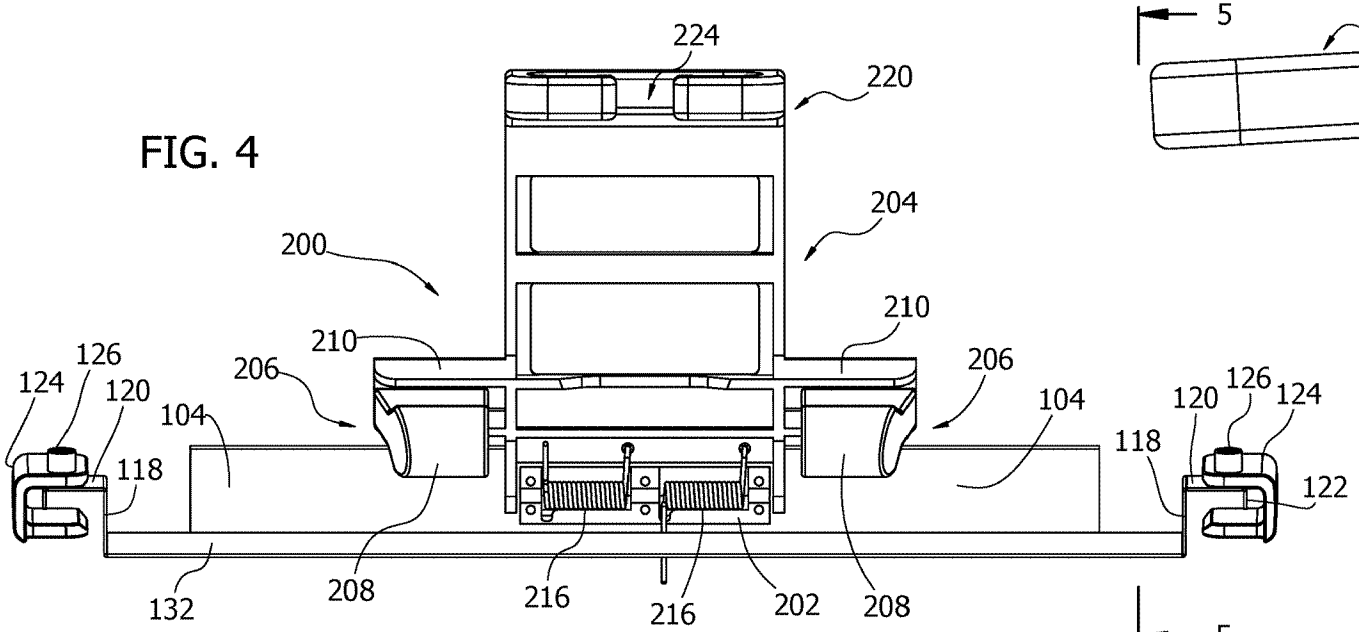
FIG. 4 is a front elevation view of the wringer assembly shown in FIGS. 1-3.
Figure 6:
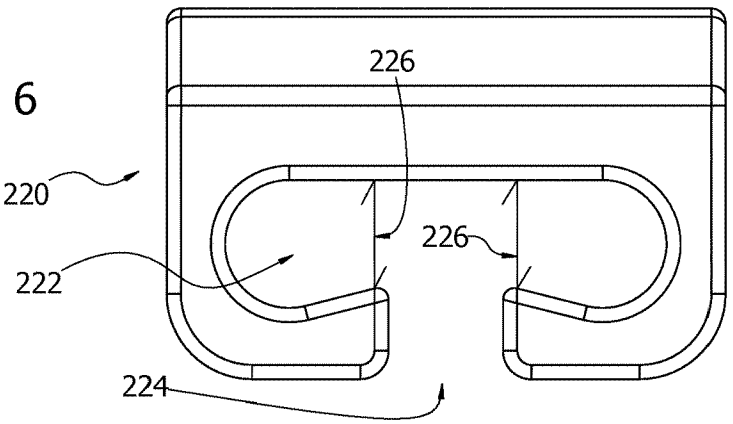
FIG. 6 is a top plan view of an actuator lever of the wringing assembly of FIG. 1-3.
Figure 7:
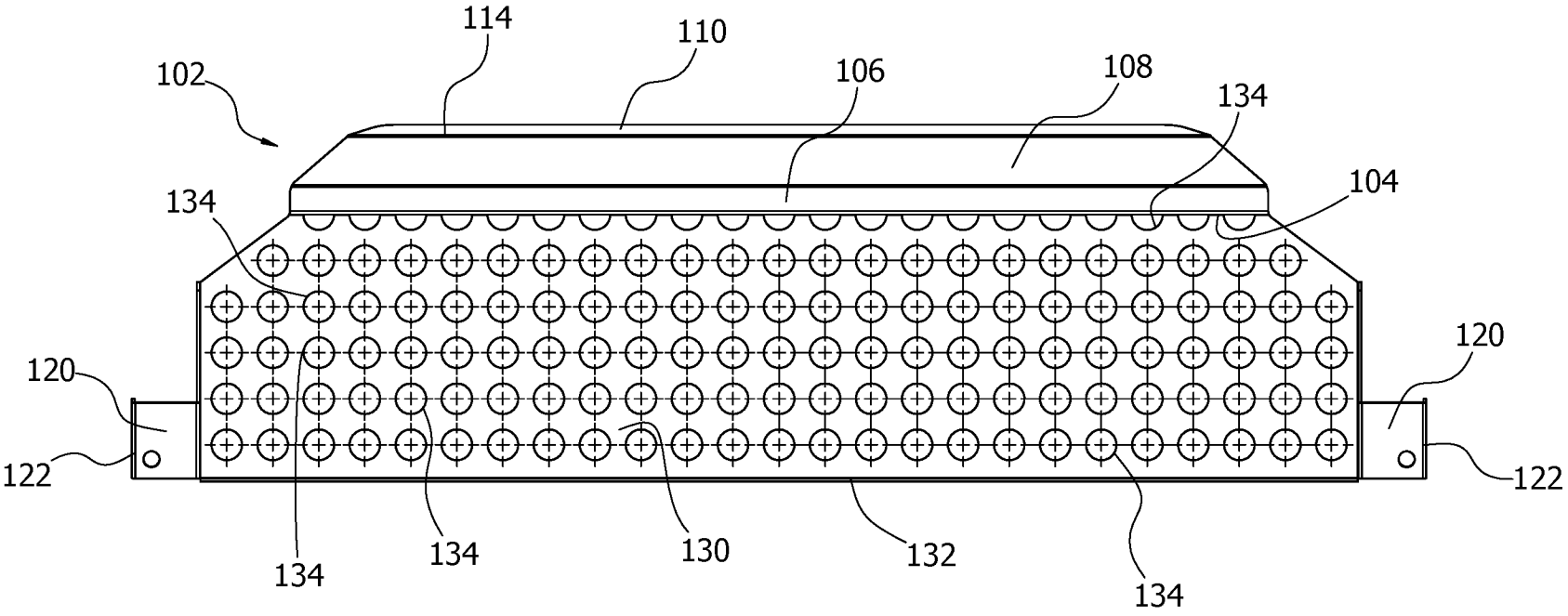
FIG. 7 is a top plan view of a wringing element such as used in the wringing assembly of FIGS. 1-6.

As illustrated, the clamp assembly 116 includes an upwardly-extending wall 118 joining a substantially horizontal support wall 120 (FIG. 4). The walls 118 and 120 extend adjacent and across, respectively, a sidewall and upper surface of a rim of the bucket 50 on which the wringer assembly is supported. The clamp assembly also includes a downwardly extending wall 122, so that the walls 118, 120 and 122 form a downwardly facing U-channel extending on or over a rim of the bucket 50. A U-shaped bracket 124 includes a fastener 126 retained in a sidewall of the U-shaped bracket and configured in such a way that the fastener can bring the U-shaped bracket against an underside of the bucket rim and clamp the clamp assembly on the rim of the bucket. Other securement assemblies can be used, depending on the wringer configuration and the container configuration.

In the present example, the wringer assembly is illustrated as being supported on double buckets, positioned adjacent each other along their long sides. The wringer assembly can also be supported on a single bucket such as the bucket 50 illustrated in FIG. 1-3.

The wringer assembly includes a wringing surface 130 (FIGS. 1-3) extending longitudinally or laterally of the assembly between the opposite upwardly-extending walls 118 and depth wise from a front, substantially perpendicular wall 132 to the wall 104. The perpendicular wall 132 provides structural support and helps to position a mop on the wringing surface 130, but the wall can be configured otherwise, including for example downwardly, or omitted. The wringing surface 130 includes the desired number, size and orientation of apertures, openings or other fluid shedding configurations 134. As illustrated, the openings 134 occupy the entire upwardly-facing surface of the wringing surface as illustrated. Additionally, portions of some of the openings are formed in the rear junction between the wringing surface 130 and the support wall 104, for example to help drain fluid. In an alternative configuration, the wringing surface 130 can be concave upward as viewed in the Figures, either in the lateral direction, the transverse direction or both.

In the present example, the wringing assembly is supported on a bucket having a bucket wall 54 that is slanted outwardly from the bottom of the bucket, and supports the wringer assembly such that the wringing surface 130 slopes downwardly and rearwardly from a center portion of the bucket to the wall 54. Other configurations are possible, and the wringing surface can be configured relative to the support wall 104 to have a greater slope downward or a lesser slope downward, or no slope and can be substantially flat, for example by configuring the angle between the wringing surface 130 and the support wall 104 and the respective heights of the upwardly-extending walls 118. The wringing surface 130 can also be sloped upward from a center portion of the bucket to the support wall 104.

The wringing assembly also includes a wringing actuation assembly 200 (FIGS. 1-7). The wringing actuation assembly initiates and completes wringing of a cleaning or absorbent element, for example on a mop or other tool. The wringing actuation assembly 200 can take a number of configurations, and can be supported as part of the wringing assembly in a number of configurations. In the present example, the wringing actuation assembly 200 is supported on the wall 104. In the illustrated configuration, the wringing actuation assembly is supported on the wall 104 raised from the surface of the wringing surface 130, for example a distance sufficient to allow a mop element to extend in a space between the wringing surface 130 and a point on the wall 104 where the wringing actuation assembly is attached or supported. The wringing actuation assembly includes a stationary support element 202 fixedly mounted to the wall 104, for example through rivets, bolts, other fasteners or welding or other securement. The stationary support element 202 includes a mounting plate sufficiently large to withstand the stresses to be encountered during normal wringing action.

The wringing actuation assembly also includes a movable assembly for carrying out the wringing process. In the present example, the movable assembly of the wringing actuation assembly 200 includes a movable arm 204. The movable arm 204 is pivotably supported on the stationary support element 202. The movable arm is movable through an arc, in the present example an arc of less than approximately 90°. In the illustrated configuration, the arc is a function of the spacing of the wringing surface 130 and pressure application components described more fully below, for example between 60 and 80°. The movable arm can serve as a handle for a user to initiate and carry out the wringing process, and additionally or alternatively can serve as a receptacle for a mop or other tool handle for initiating and carrying out the wringing process. The movable arm is configured to have a structure sufficient to reliably apply pressure for the wringing action and allow for smooth operation.

The wringing actuation assembly also includes at least one and in the illustrated examples a plurality of pressure applicators 206 for applying pressure to a cleaning element, absorbent element or a mop material, for example for extracting fluid from the mop material. As illustrated, the plurality of pressure applicators are a pair of pressure applicators, configured to apply pressure in the direction of the wringing surface 130, when the wringing actuation assembly is moved arcuately sufficiently so that the pressure applicators contact the item to be wrung. The pressure applicators can take a number of configurations, and in the illustrated configurations are mirror images of each other, and only one of which will be described in detail herein. Each pressure applicator includes a longitudinally extending surface 208, which in the present configuration extends laterally substantially parallel to the planar surface of the wringing surface 130. Additionally, the surfaces 208 at a given longitudinal position extend arcuately to form part of a circle (for example with a diameter of about 1.23 in. and radius of about 0.6 in. for wringing 9 and 10 inch mop heads) in transverse cross-section, so that each of the pressure applicators have a cylindrical geometry with the outer surfaces extending longitudinally substantially parallel to the planar surface of the wringing surface 130. In such a configuration, each pressure applicator will contact a tool element to be wrung, for example a mop head, over a linear area approximating the longitudinal extent of the adjacent surface. In the present configuration, each pressure applicator will make contact for a wringing action along a general line within plus or minus 20-30° of the center of the arcuate surface of the cylindrical body.

Each pressure applicator 206 is supported on the movable arm 204 so that it is spaced apart longitudinally from the other pressure applicator. As illustrated, the pressure applicators are supported outboard of the movable arm, but they can be supported in board, or under the lateral edges of the movable arm, or otherwise. The pressure applicators can be supported in a number of ways, and in the present configuration are supported to be movable in U-channels 210. Also as illustrated, each of the pressure applicators is supported so as to be biased outward of the U-channel and toward the wringing surface when the pressure applicators are adjacent the wringing surface, for example when the movable arm has been moved through an arc closer to the wringing surface. In the present example, each pressure applicator is spring biased in the U-channel with first and second springs 212 retained with the respective fasteners 214. The springs 212 bias the pressure applicators outward.

In the illustrated configuration, the wringing actuation assembly includes one or more bias elements such as coil springs 216 (FIG. 4) configured for biasing the movable arm to an upper or non-wringing configuration. Other means may be used additionally or alternatively to bias the movable arm upward or to an open or non-wringing configuration.

The wringing actuation assembly may also include if desired a mop handle or other tool element receptacle for receiving and/or engaging a tool element, for example a mop handle. The receptacle may be used for positioning the tool element, for example by using the bias provided by the springs 216 to position the tool element in an upward position relative to the wringing assembly, or may be used for actuating the wringing assembly by moving the tool element, for example against the bias of the springs 216. In the present example, the movable arm includes a longitudinally and transversely extending plate or flange 220, in the present example at a top or end of the movable arm opposite the support 202. The flange extends inward in a direction over the wringing surface 130, for example sufficient to allow a mop handle or other tool element to be positioned above the wringing surface 130 when the wringing actuation assembly is in an upward configuration as illustrated in FIG. 2. The flange includes a cavity 222 behind an opening 224 (FIG. 6) into the cavity from a front surface of the flange. The opening 224 is sufficiently large to allow the desired ingress and egress of the handle or other tool element during normal operation. In the present example, the cavity 222 is an approximate oval with the minor axis of the oval being smaller than a minor axis of an exact oval having straight sides. The ends of the oval have inside radii defining a half circle for the end of the oval, and then that extend more than 180°, so that the spacing 226 at the closest approach toward either end of the oval is less than a diameter across the end of the oval. This configuration of the cavity 222 allows easier positioning and holding of a mop handle or other tool element at one end or the other of the cavity, for easier operation of the wringing actuation assembly using the mop handle or other tool element, or manually while the mop handle or other tool element is positioned in the cavity.

A bucket positioning device may be used with a number of bucket configurations, and in the present examples may be used with the buckets 50 for positioning dual buckets next to each other. In one example, a bucket holder 300 (FIGS. 7-10) is a spring-biased assembly for holding one or both of upper and lower portions of adjacent buckets together. In the present example, the bucket holder holds both the upper and lower portions, and as illustrated holds the top and bottom portions of the adjacent buckets. The bucket holder is spring biased to allow the length of the bucket holder to be increased to fit over rims of adjacent buckets, and also to accommodate variations in bucket heights and possibly rim configurations. The bucket holder 300 includes a base unit 302 for engaging bottom structures of adjacent buckets, a strut or spoke 304, which in the present examples may be resiliently flexible perpendicular to its axis, and a bucket rim clamp 306.

Figure 11:
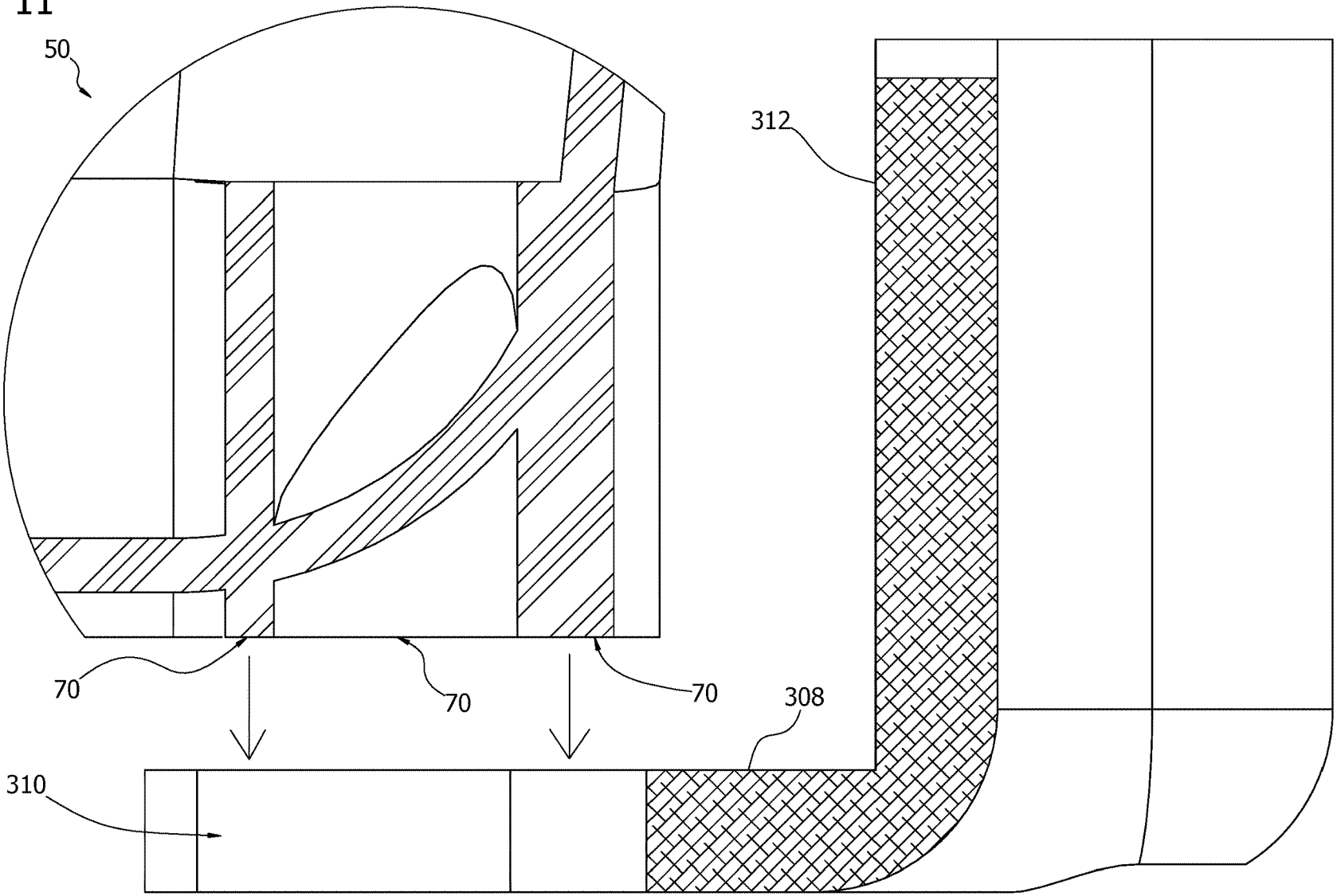
FIG. 11 is a cross section and detail exploded view of a portion of a bucket and bucket clamp assembly illustrating how a portion of the bucket would engage a portion of the bucket clamp assembly.

The base unit 302 includes a substantially horizontal baseplate 308 sized sufficient to span between and include adjacent corners of adjacent buckets. The base plate includes a plurality of engagement surfaces, in the present example a pair of engagement slots 310. The engagement slots 310 engage substantially complementary posts, pegs or legs 70 (FIG. 11) in respective corners of respective buckets, or respective wheel units on the bottoms of the buckets.

The base unit also includes a side plate 312 extending upward from the baseplate, and can help position the bucket positioning device relative to the adjacent sides of the buckets. The side plate 312 also includes a cavity 314 (FIG. 10) for housing a coil or compression spring 316 for biasing the strut 304 downward relative to the orientation illustrated in FIG. 10. The strut includes a flange 318 or other structure for retaining the lower end of the strut within the cavity. The strut extends through an opening in an upper portion of the housing for the coil to an upper end, having a similar flange 324 retaining the rim clamp 306 on the strut.

Figure 10:
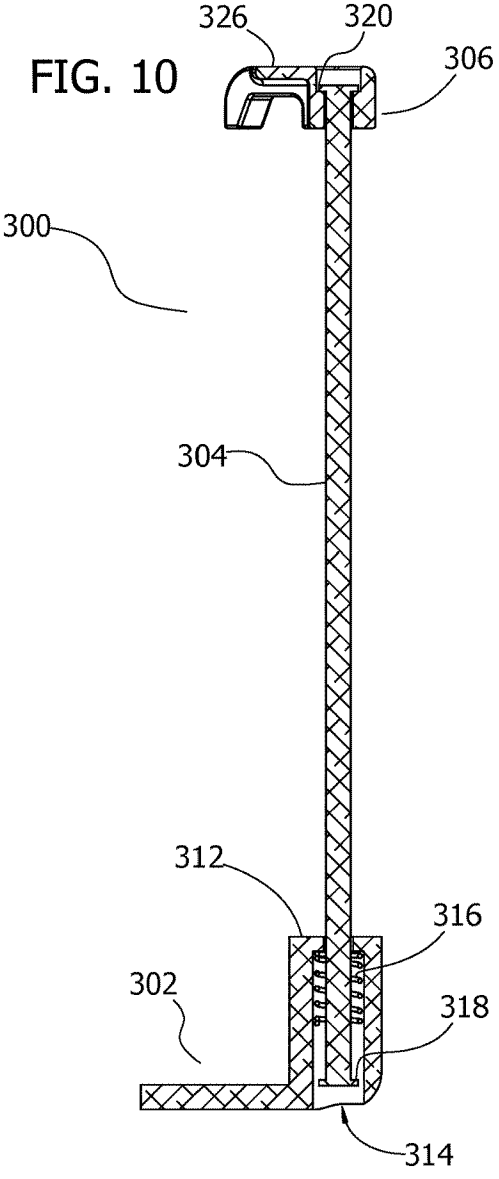
FIG. 10 is a sagittal section of the bucket clamp assembly of FIG. 8 taken along lines 9-9 of FIG. 9.
Figure 9:
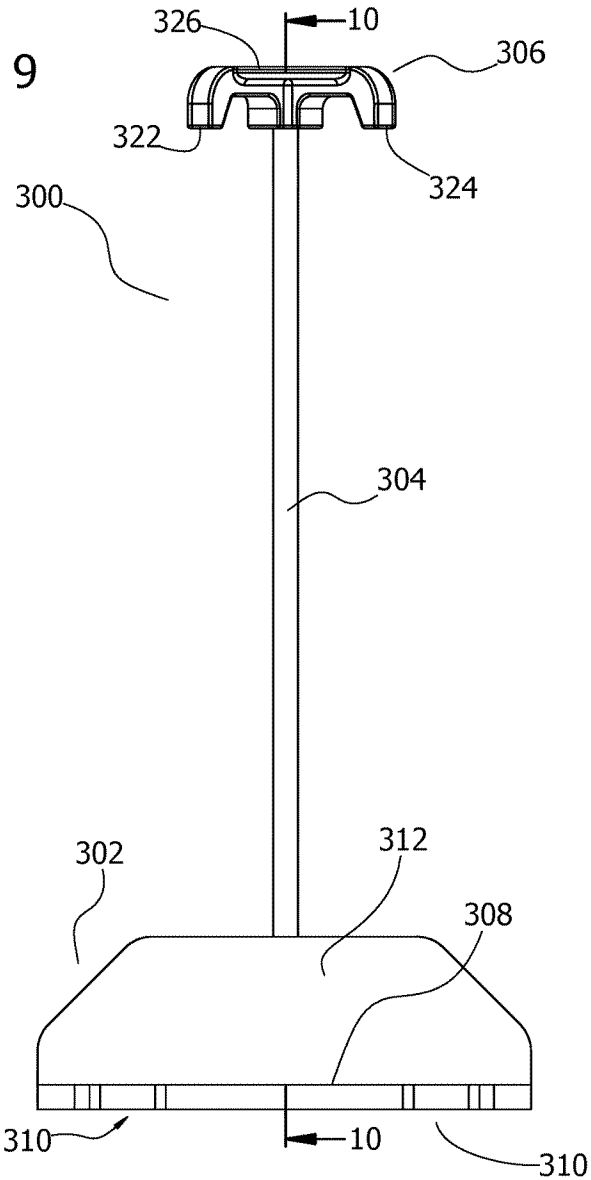
FIG. 9 is a front elevation view of the bucket clamp assembly of FIG. 8.
Figure 8:
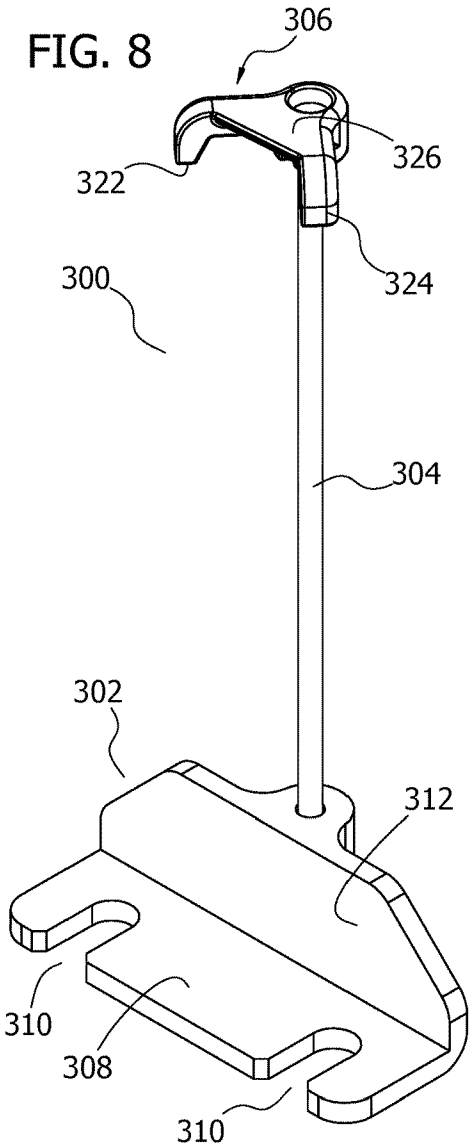
FIG. 8 is an upper left isometric view of a bucket clamp assembly.

The rim clamp 306 includes first and second hooks 322 and 324, for extending over and engaging respective rim portions in corners or other similar adjacent locations of adjacent buckets. The hooks have lengths extending away from the strut 304 sufficient to extend over the rim surface of the intended bucket combination. The hooks have respective end portions that extend downward toward the base unit a distance sufficient to reliably engage the clamp with the rims of the adjacent buckets. In the present example, the hooks extend at an angle of approximately 90° relative to each other. Other angular spacing is possible. The hooks are supported in their spacing by a web 326 (FIGS. 8-10).

In operation, a mop assembly 400 (FIGS. 2-3), for example a mop assembly such as that described and illustrated in US 2016/0031073, the contents of which are incorporated herein by reference, may have a mop head 402 supported on an articulating assembly 404 coupled to a handle 406. The mop head includes an absorbent or wiping or cleaning material (not shown) to be wrung out by the wringing assembly. The mop head 402 may include a substantially rigid plastic planar member or members supported on the articulating assembly 404. The mop head is placed against the wringing surface 130 for wringing the material on the mop head. The mop handle can be placed down on the rim of the bucket away from the wringing actuation assembly, or can be placed in the cavity 222. The user can actuate the wringing assembly manually by pressing against the movable arm to pivot it over the associated bucket 50, thereby moving the pressure applicators 206 closer to and ultimately against the upper surface of the mop head 402. As the pressure applicators contact the upper surface of the mop head, the springs 212 compress while the pressure applicators apply more pressure to the mop head, thereby wringing fluid from the material (not shown) on the mop head. When the pressure applicators bottom out in their respective U channels, or when the movable arm reaches an optional stop surface (not shown), wringing is complete for the intended configuration, and the movable arm can be returned to its upright position, either manually, with the handle 406, and/or with the bias of the springs 216.

In the illustrated configuration, the pressure applicators 206 are positioned equidistant or symmetric on opposite sides of the articulating assembly 404, and in the present examples equidistant or symmetric on opposite sides of the movable arm 204 and are substantially centered transversely of the wringing surface 130.

An alternative configuration of a wringer assembly can include an alternative handle-holding component and/or an alternative pressure applicator. In one example, a wringer assembly 500 (FIGS. 12 and 13) includes the same components as the wringer assembly illustrated and described with respect to FIG. 1, and can be configured to be used with any of the assembly configurations described herein, including the double bucket assembly described in conjunction with FIGS. 1-3. In one example, the actuator can include an alternative handle-holding element 600 (FIGS. 12-14) having a single cavity for receiving a mop handle, for example, and having similar functions as described with respect to the flange 220 described herein.

The handle-holding element 600 is supported by the actuator assembly, and includes a side opening 602 sized sufficiently to accommodate a mop handle of the expected configuration. The opening can be positioned on either side of the handle-holding element. In the present example, the opening 602 is on the right side, and provides access to a first concave surface 604. The first concave surface 604 helps to guide the mop handle further into a cavity 606. The cavity is defined in part by the first concave surface 604, and in part by a second concave surface 608 separated from the first concave surface by a projection or peak 610, helping to define the first and second concave surfaces.

The handle-holding element 600 in the present example includes a third concave surface 612 for accommodating a portion of a mop handle. In the illustrated example, the third concave surface 612 provides a recess for a mop handle, for example, and for receiving pressure from the mop handle as applied by the user to carry out a wringing process, and apply pressure to a mop head, as described herein. In the illustrated configuration, the third concave surface 612 is approximately opposite the projection or peak 610.

The second concave surface 608 is positioned at the end of the cavity 606 opposite the opening 602. The second concave surface 608 can reliably position a mop handle, for example in a storing or stowed configuration, for example when the actuator and an associated mop handle are approximately vertical. The actuator and mop handle in an approximately vertical configuration can be used for stowing the assembly, or repositioning the bucket assembly, or otherwise.

Figure 12:
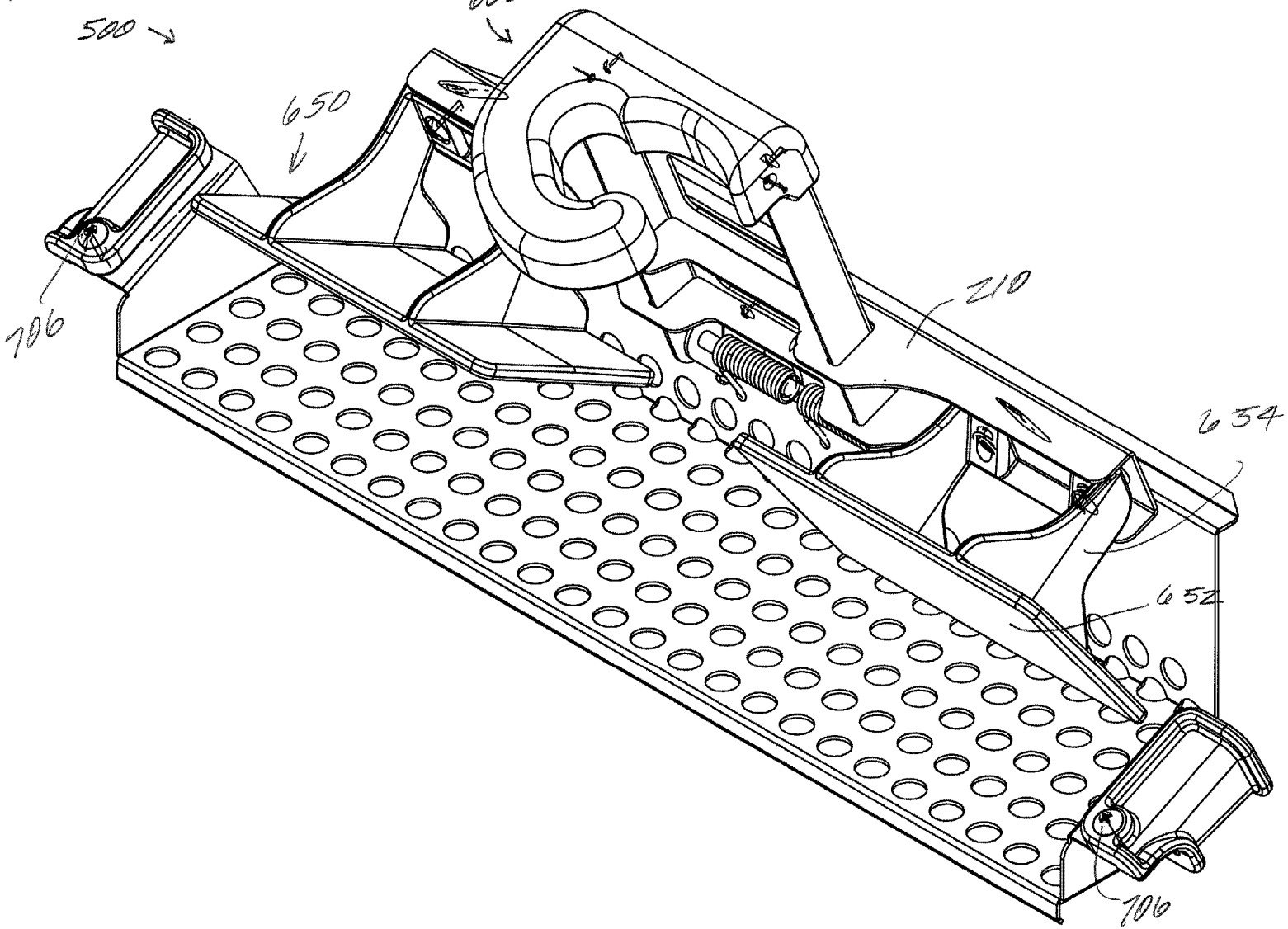
FIG. 12 is an upper left isometric view of another example of a wringer assembly having another example of a handle holding assembly and pressure application assembly that can be used with any of the bucket assemblies described herein.
Figure 13:
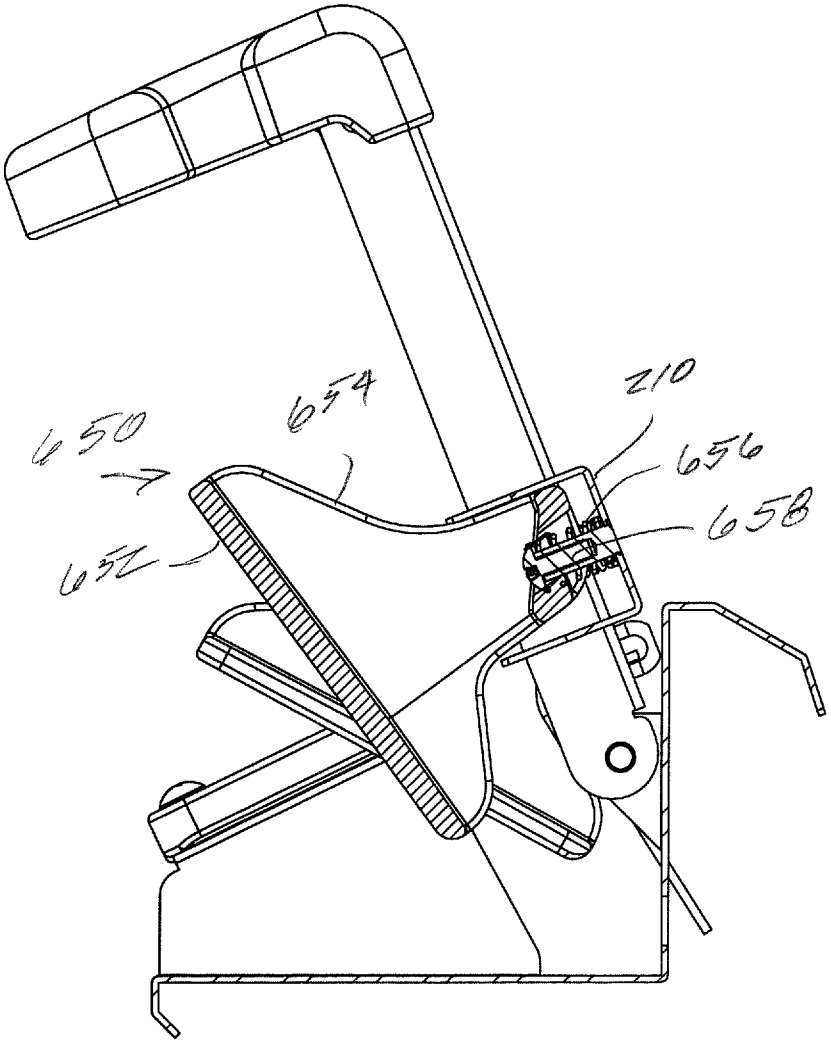
FIG. 13 is a vertical cross-section of a portion of the assembly of FIG. 12 showing a pressure application assembly in a depressed configuration.
Figure 18:
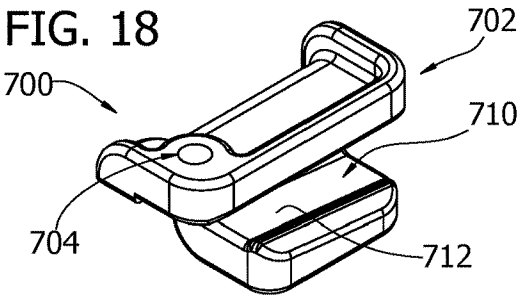
FIG. 18 is an upper isometric view of a swivel lock for use with the assembly of FIG. 12.
Figure 21:
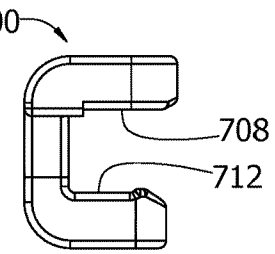
FIG. 21 is a rear elevation view of the lock of FIG. 18.
Figure 19:
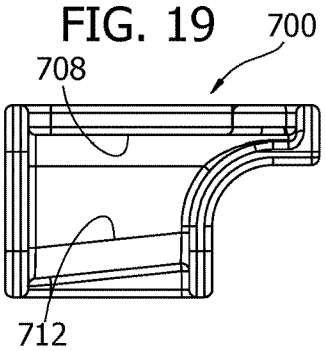
FIG. 19 is a side elevation view of the lock of FIG. 18.
Figure 22:
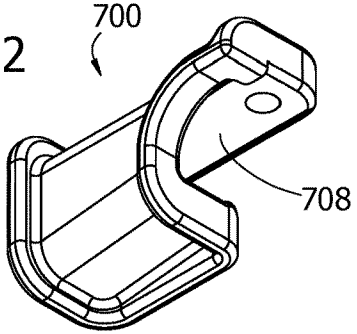
FIG. 22 is a lower isometric view of the lock of FIG. 18.
Figure 20:
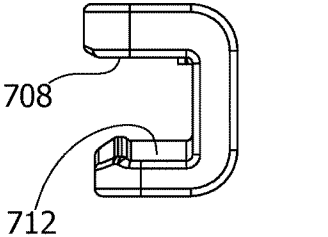
FIG. 20 is a front elevation view of the lock of FIG. 18.
Figure 14:
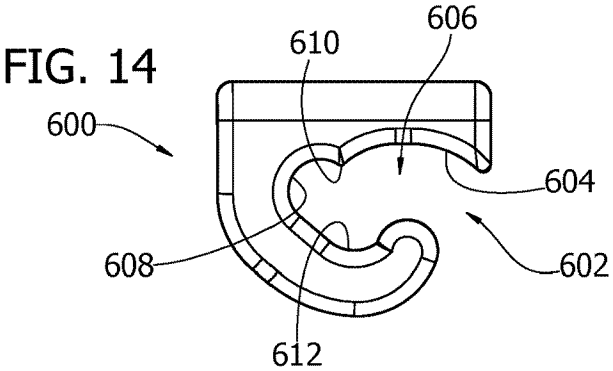
FIG. 14 is a top plan view of a Handle-Holding element.

An alternative configuration of a wringer assembly can also or alternatively include an alternative pressure applicator, for example pressure applicator 650 (FIGS. 12 and 13). In the present configuration, the pressure applicators 650 are supported in the U-channels 210 in a manner similar to that described herein. The pressure applicators 650 in the present example include substantially planar pressure surfaces 652 for contacting associated portions of a mop head for wringing a cleaning surface on the mop head, for example the mop head shown in FIGS. 2-3. The pressure surfaces 652 are supported in the U-channel by suitable support structures, for example flanges 654. Flanges 654 may have a profile, for example as shown in FIG. 13, that biases the pressure surfaces 652 in a direction tending to maintain the pressure surfaces 652 generally parallel to the wringing surface, for example wringing surface 130. The profile as viewed from the side in FIG. 13 of the flanges 654 when engaging the U-channel 210 tends to position the pressure surfaces 652 more parallel to the wringing surface.

In the illustrated configuration, the pressure applicators 650 are shown in FIG. 12 with the left side pressure applicator in a fully extended condition and the right side pressure applicator in a retracted or contracted configuration and angled in such a way that the pressure applicator surface tends to remain parallel to the wringer surface as the actuator moves the pressure applicators toward the mop head and toward the wringing surface.

The pressure applicators are secured in the U-channel 210 with a respective spring 656 biasing the pressure applicator outward of the U-channel. In the configuration illustrated in FIGS. 13, the proximal pressure applicator 650 is illustrated as though the pressure applicator had previously contacted a mop head and continued to apply pressure to the mop head as the actuator moves in a counterclockwise direction as viewed in FIG. 13.

Figure 16:
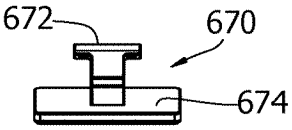
FIG. 16 front elevation view of the pressure application component of FIG. 15.
Figure 15:
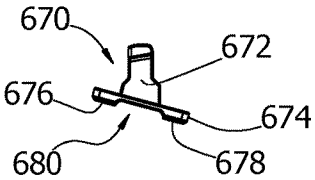
FIG. 15 is a side elevation view of another pressure application component that can be used with the wringer assembly of FIG. 12.

In the present example, the pressure applicators 650 are configured so that the flanges 654 position the pressure surfaces 652 at an angle to and not parallel to the bottom of the U-channel or to the actuator arm. Viewed in another way, the pressure surfaces 652 are other than perpendicular to the axis of the springs 656 and the fasteners 658 securing the pressure applicators 650 in the U-channel 210. The angular orientation of the pressure surfaces relative to the support flanges is illustrated in an alternative configuration in FIGS. 15-16, discussed more fully below.

Figure 17:
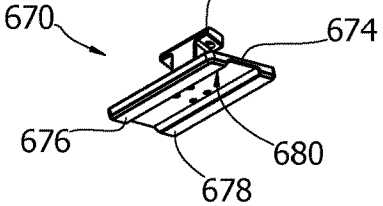
FIG. 17 is a lower isometric view of the pressure application component of FIG. 15.
Figure 25:
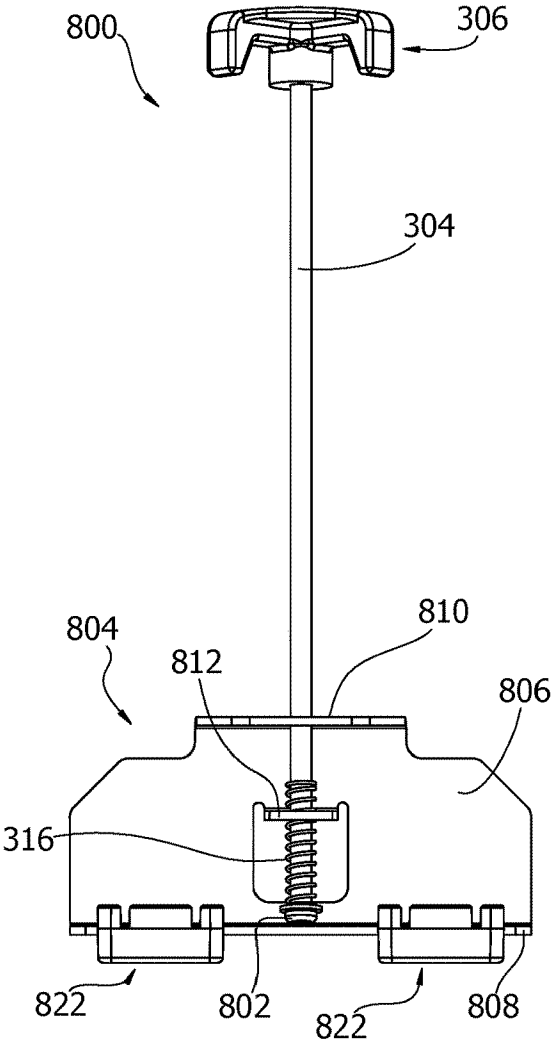
FIG. 25 is a front elevation view of the bucket retainer of FIG. 23.
Figure 24:
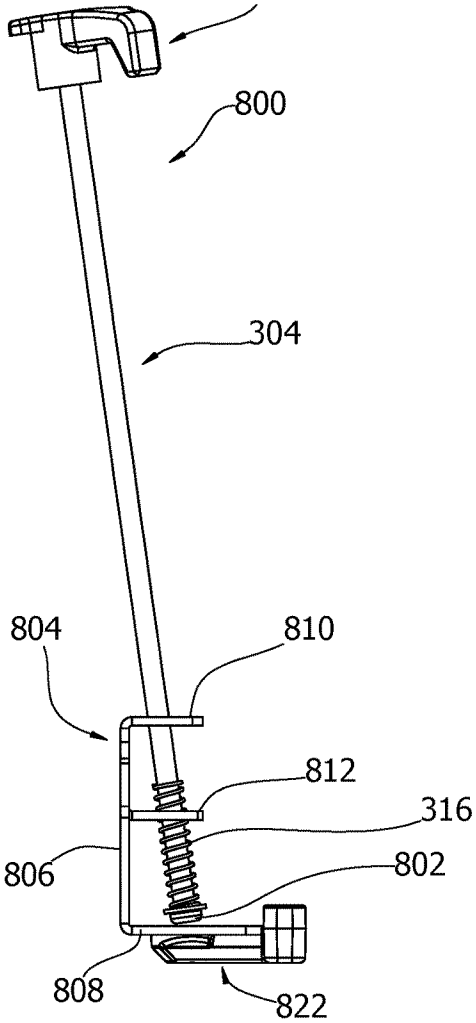
FIG. 24 is a side elevation view of the bucket retainer of FIG. 23.
Figure 23:
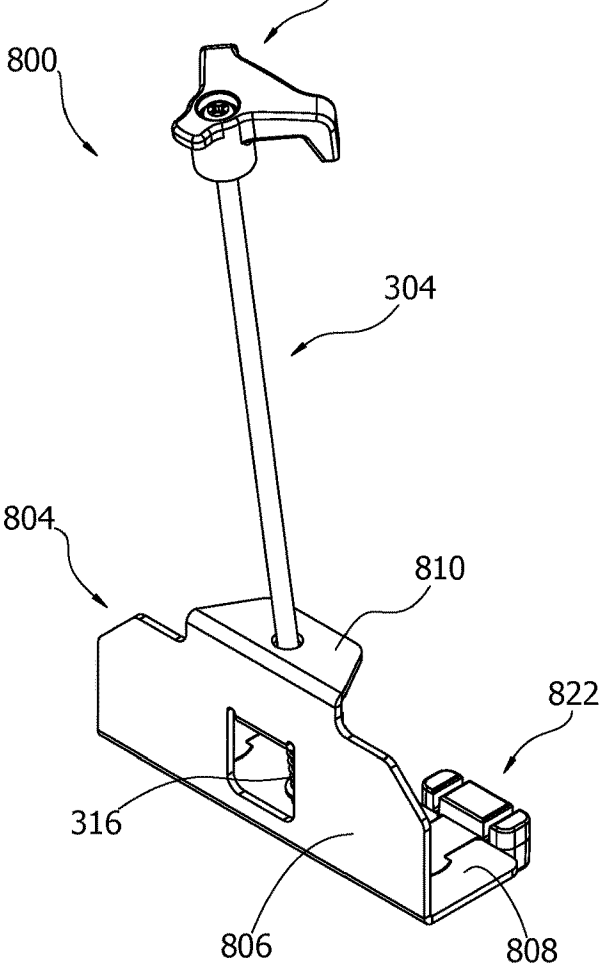
FIG. 23 is an upper isometric view of a bucket retainer according to another example that can be used with any of the assemblies described herein.
Figure 30:
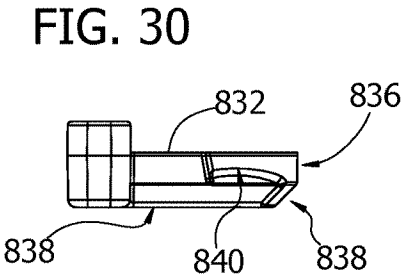
FIG. 30 is a side elevation view of the wheel spacer of FIG. 26.
Figure 31:
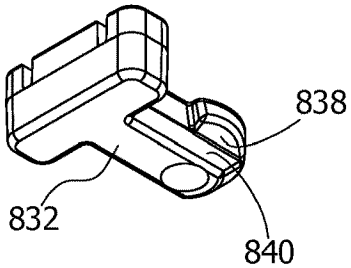
FIG. 31 is a lower isometric view of the wheel spacer of FIG. 26.
Figure 27:
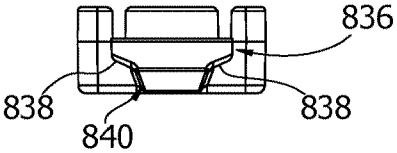
FIG. 27 is a front elevation view of the wheel spacer of FIG. 26.
Figure 28:
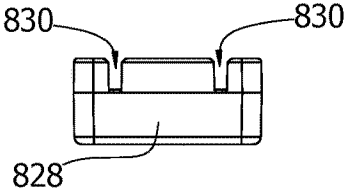
FIG. 28 is a rear elevation view of the wheel spacer of FIG. 26.
Figure 29:
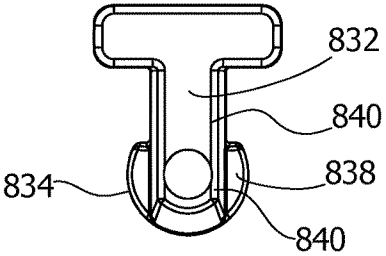
FIG. 29 is a bottom plan view of the wheel spacer of FIG. 26.
Figure 26:
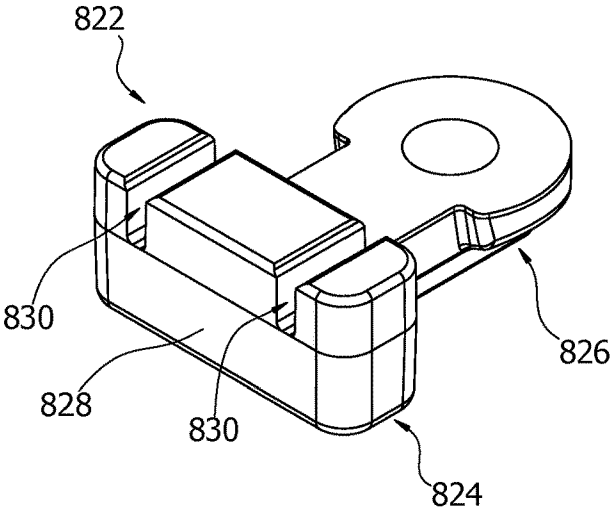
FIG. 26 is an upper isometric view of a wheel spacer that can be used with the bucket retainer of FIG. 23.
Figure 32:
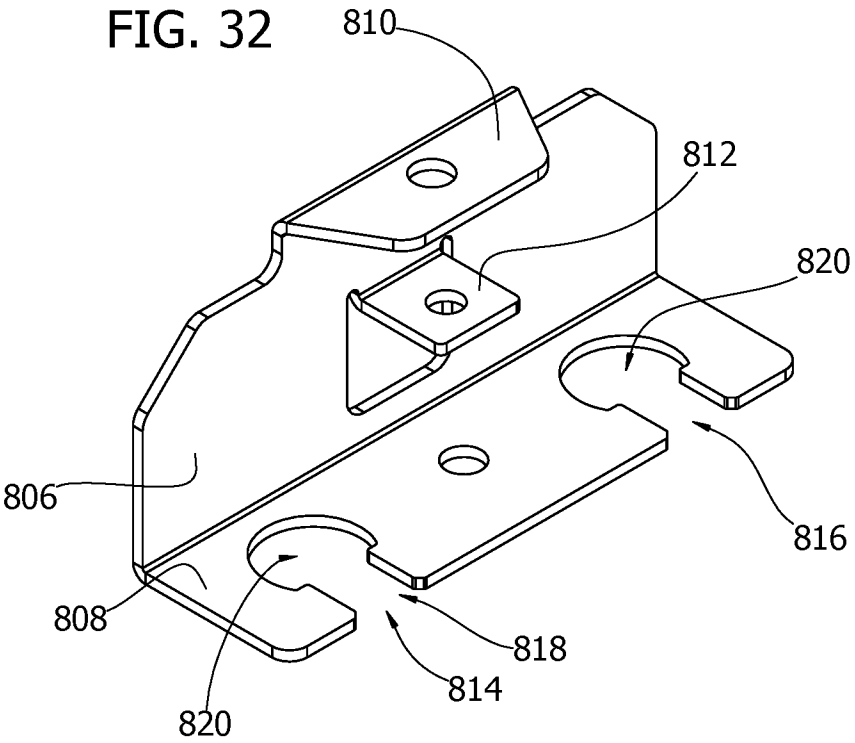
FIG. 32 is an upper isometric view of a bracket for the bucket retainer of FIG. 23.

Another configuration of pressure applicators (FIGS. 15-17) includes pressure applicators 670 having a support structure 672 supporting a pressure applicator plate 674 so that the pressure applicator plate extends at an angle to the support structure 672. The pressure surfaces 652 in the configuration illustrated in FIGS. 12-13 can be supported by a structure the same as or similar to the support structure 672. In the present example of the pressure applicators 670, the pressure surfaces are bifurcated pressure surfaces 676 and 678 separated by a channel 680. Other configurations of pressure surfaces may be used.

An alternative configuration of a wringing assembly can use a clamp assembly having an angled surface. In one example, a clamp assembly 700 (FIGS. 18-22) includes an upper portion 702 for contacting an upper portion of a bucket rim, such as edge 66 (FIG. 1), and a fastening component 704, in the present example an opening for receiving a suitable fastener, such as fastener 706 (FIG. 12). The fastening component 704 in the present configuration allows the clamp assembly to pivot to engage the rim of a bucket to which the wringing assembly is secured. In the present example, the upper portion 702 conforms to the profile of the upper rim of the bucket to which it is to be secured, and in the present example, has a flat under surface 708.

The clamp assembly 700 includes a wall defining a channel having a lower surface 710 for extending under a rim or edge of an upper portion of a bucket to which the wringing assembly is secured. In the present example, the lower surface 710 includes a slope or ramp surface 712. The slope surface 712 helps to secure the wringer assembly on the supporting rim of a bucket or other structure. In the present example, the slope surface 712 is spaced apart from the flat under surface 708 a varying distance from one end of the clamp assembly to the other. Alternatively, the distance may vary over less than the entire length of the clamp assembly. In the illustrated configuration, the slope surface distance from the flat under surface 708 varies a constant amount per unit length. Alternatively, the variation may change over the length of the clamp assembly.

In the present example, the spacing of the slope surface 712 from the flat under surface 708 is smallest closer to the fastening component 704. Alternatively, the spacing can be smallest further away from the fastening component.

In another example of a bucket positioning assembly (FIGS. 23-32), a bucket positioning assembly 800 includes the same strut 304 and same rim clamp 306 and spring 316 described herein with respect to the positioning assembly 300 (FIGS. 8-10). They have substantially the same structure and function as previously described, but other components can be used in a bucket positioning assembly in the alternative or in addition. In the example illustrated, the strut 304 terminates in an end cap 802 formed in or attached to the end of the strut 304 at the end opposite the rim clamp.

The bucket positioning assembly 800 includes an alternative base 804. The base 804 is positioned on the strut 304 such that the strut extends in an inside area of the base, whereas in the example in FIGS. 8-10 the strut extended to an outside area of the base. The base includes an upright wall 806, which in the present example extend substantially vertically when the assembly is in position on a bucket. The upright wall 806 extends widthwise in the illustrated example sufficient to span the spacing between two conventional utility buckets, such as those illustrated in FIGS. 1-2. The upright wall 806 supports a bottom wall 808, described more fully below. In the present example, the upright and bottom walls are substantially perpendicular with respect to each other. The upright wall also includes or has formed in it first and second strut engagement walls 810 and 812, for engaging the strut and allowing the strut to support the base 804. In the present example, the first engagement wall is above the second engagement wall, and are formed from the upright wall. The first and second engagement walls include respective openings for receiving the strut, and the openings are aligned so that the strut extends at an angle to the upright wall 806. The angle allows the base 804 to extend to bucket bases under a bucket rim. The opening in the second engagement wall is sized so as to keep the spring 316 between the end cap 802 and the second wall 812.

The bottom wall 808 includes an engagement configuration that limits planar movement of the base relative to an adjacent bucket or bucket assembly. While the base 302 in FIGS. 8-10 limits lateral or longitudinal movement between the base and an associated bucket in the widthwise direction of the base 302, it does not limit in line or a transverse movement between the base and a bucket. In the present example of the base 804 in FIGS. 23-25, the bottom wall 808 includes at least one, and in the present example two or a plurality of, openings that have a geometry in conjunction with which a complementary geometry would limit planar movement between the base and the structure associated with the complementary geometry. In the example illustrated, the geometry of the first and second openings 814 and 816, respectively, are analogous to keyhole geometries, but other geometries substantially limiting planar movement, or longitudinal and transverse movement could be used. In the present example, each of the plurality of openings are identical, but they can be different if orientation might be a factor. As illustrated, each opening includes a transverse slot 818 with a substantially straight parallel walls spaced apart from each other at a first distance, and a partially curved, in the present example circular, opening 820 interior to the transverse slot, having part of a longitudinal dimension greater than the first distance. Other geometries are possible for limiting planar movement. In the present example, the openings together permit perpendicular movement of a complementary geometry, in a direction substantially normal to the bottom wall 808.

One example of a complementary geometry is termed only for purposes of identification and discussion a key element 822 (FIGS. 23-31), and in the examples illustrated, the base 804 would include two key elements. Where the openings 814 and 816 are identical, the key elements would generally be identical as well. In the present example, they are identical, and only one will be described further.

In the present example, the key elements 822 would be mounted to an associated surface on the bottom of a respective bucket, such as those illustrated in FIGS. 1-2. Each key element may be used for a particular bucket, or may be made universal for several bucket configurations. In the present example, each key element would be mounted, secured or otherwise positioned on a respective bucket, and used with that bucket and a complementary bucket positioning assembly. Conversely, key elements may be associated with the bucket positioning assembly, and keyhole elements or other complementary structures formed in or otherwise associated with buckets to be used with the bucket positioning assembly.

The key element 822 includes a bucket engagement element 824 and a key structure 826. The bucket engagement element 824 includes a base 828 and one or more slots 830 for engaging flanges or other wall elements in the bottom or side of a bucket. The bucket engagement element may secure the key element by interference fit, or other securement.

The key structure 826 has a geometry substantially conforming to the geometry of the respective opening. In the present example, the key structure includes a substantially straight arm 832 (when viewed in plan), and a partly circular end 834, at an end of the arm 832 distal of the base 828. The straight arm and the circular end both have a height, and engagement portion 836 of which has a height at least the same as the thickness of the bottom wall 808, but the height may be greater if desired, or may also be less.

Each of the straight arm 832 and the circular end 834 also have respective lower portions 838 and 840, respectively, extending in a direction opposite a direction in which the slots 830 extend, or in other words in a direction away from a rim of a bucket and away from the clamp element 306. In the present example, each of the straight arm lower portion 838 and the circular end lower portion 840 have converging walls, converging in a direction away from the respective straight arm and circular end. As illustrated, the converging walls are continuous for both the straight arm and the circular end, but they can be discontinuous. The converging walls form approach surfaces. The approach surfaces help to guide the bottom wall 808 of the bucket positioning assembly over the respective key elements until the key elements are sufficiently seated in the respective openings in the bottom wall 808. The openings and the key elements help to position the bottom wall and to maintain the buckets in position relative to each other, and help to maintain the bucket positioning assembly in position relative to a given bucket or bucket assembly.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A bucket positioning assembly comprising means for extending on a rim of a bucket, a base for extending adjacent a bottom of a bucket, means for coupling the extending means and the base, and wherein the base includes a structure having a geometry for engaging a component associated with the bottom of the bucket wherein the structure limits planar movement between the structure and the component associated with the bottom of the bucket, and wherein the base includes at least one opening defining the geometry, and wherein the opening includes a wall having a straight portion and a curved portion;

wherein the means for extending on the rim of the bucket includes a dual hook component having first and second hooks, the first hook for extending over and adjacent a rim of a first bucket and the second hook for extending over and adjacent a rim of a second bucket;

wherein the base structure having a geometry includes a bucket base bracket having first and second side portions, wherein the first side portion is configured to engage a complementary surface in a bottom portion of a first bucket, and the second side portion is configured to engage a complementary surface in a bottom portion of a second bucket, and wherein the bucket base bracket further includes a retaining housing for retaining a rod;

wherein the coupling means includes the rod extending between the dual hook component and the bucket base bracket, and including a spring associated with the rod and engaging a portion of the retaining housing in the bucket base bracket, wherein the spring biases the bucket base bracket and the dual hook component closer together;

wherein the bucket base bracket includes first and second flange elements having respective first and second flange openings for receiving the rod; and wherein the spring is positioned between the second flange element and the first and second side portions of the bucket base bracket, on an opposite side of the second flange element from the first flange element.

2. The assembly of claim 1 wherein the first and second hooks of the dual hook component form respective first and second arms extending from the rod to respective ends curving downward in a direction away from the dual hook component.

3. The assembly of claim 1 wherein the bucket base bracket includes an upper spacer component for defining a minimum spacing between adjacent surfaces of the first and second buckets.

4. The assembly of claim 1 wherein the curved portion in the opening wall includes a partly circular portion having a first dimension and wherein the straight portion is one of a plurality of straight portions spaced apart from each other a second distance wherein the second distance is less than the first dimension.

5. The assembly of claim 1 wherein the at least one opening is formed in a bottom plate extending at a substantially obtuse angle relative to an axis of the rod.

6. A bucket positioning assembly comprising at least one hook for engaging a rim of a bucket, a base for extending adjacent a bottom of a bucket, a strut for coupling the at least one hook and the base, and wherein the base includes a structure having an upright wall connected to a first strut engagement wall, a second strut engagement wall, and a bottom wall; wherein the first strut engagement wall, second strut engagement wall, and the bottom wall all extend perpendicular to the upright wall; and wherein the bottom wall includes at least one opening, and wherein the at least one opening includes first and second substantially oppositely-facing walls and an at least partially curved wall extending between the first and second walls, and configured to mate with a key structure, wherein the key structure comprises at least one slot for engaging and supporting a flange of a bucket.

7. The bucket positioning assembly of claim 6 wherein the at least one hook includes a dual hook component having first and second hooks, the first hook for extending over and adjacent a rim of a first bucket and the second hook for extending over and adjacent a rim of a second bucket;

wherein the bottom wall has first and second side portions, wherein the first side portion includes the at least one opening to engage the key structure, and the second side portion is configured to engage a second key structure for engaging a complementary surface in a bottom portion of a second bucket; and further including a spring associated with the strut and engaging a portion of the base, wherein the spring biases the base and the dual hook component closer together.

8. The assembly of claim 7 wherein the base includes apertures in the first and second strut engagement walls for receiving the strut.

9. The assembly of claim 1 wherein the bucket base bracket includes a structure for receiving an end of the rod.

10. The assembly of claim 9 wherein the structure for receiving the end of the rod includes a cavity in a plate defining the first and second side portions.

11. The assembly of claim 6 further including a bias element for biasing the strut and the base toward each other.

12. A bucket assembly comprising a bucket and a bucket positioning assembly comprising means for extending on a rim of the bucket, a base for extending adjacent a bottom of the bucket, means for coupling the extending means and the base, and wherein the base includes a structure having a geometry for engaging a component associated with the bottom of the bucket wherein the structure limits planar movement between the structure and the component associated with the bottom of the bucket, and wherein the base includes at least one opening defining the geometry. and wherein the opening includes a wall having a straight portion and a curved portion;

wherein the means for extending on the rim of the bucket includes a dual hook component having first and second hooks, the first hook for extending over and adjacent a rim of a first bucket and the second hook for extending over and adjacent a rim of a second bucket;

wherein the base structure having a geometry includes a bucket base bracket having first and second side portions, wherein the first side portion is configured to engage a complementary surface in a bottom portion of a first bucket, and the second side portion is configured to engage a complementary surface in a bottom portion of a second bucket, and wherein the bucket base bracket further includes a retaining housing for retaining a rod;

wherein the coupling means includes the rod extending between the dual hook component and the bucket base bracket, and including a spring associated with the rod and engaging a portion of the retaining housing in the bucket base bracket, wherein the spring biases the bucket base bracket and the dual hook component closer together;

wherein the bucket base bracket includes first and second flange elements having respective first and second flange openings for receiving the rod; and wherein the spring is positioned between the second flange element and the first and second side portions of the bucket base bracket, on an opposite side of the second flange element from the first flange element.

* * * * *